US005351466A

United States Patent [19]

Lee

[11] Patent Number: 5,351,466

[45] Date of Patent: Oct. 4, 1994

[54] SLEEVER APPARATUS WITH SINGULATE GATE

[75] Inventor: John S. Lee, Coon Rapids, Minn.

[73] Assignee: Rimage Corporation, Minneapolis, Minn.

[21] Appl. No.: 74,391

[22] Filed: Jun. 10, 1993

[51] Int. Cl.[5] ..... B65B 43/22; B65B 43/30

[52] U.S. Cl. ..... 53/572; 53/386.1

[58] Field of Search ..... 53/564, 566, 572, 386.1, 53/573, 381.6, 570, 571, 250, 569

[56] References Cited

U.S. PATENT DOCUMENTS

| | | | |
|---|---|---|---|
| 2,952,954 | 9/1964 | Perrin | 53/571 X |
| 3,468,102 | 9/1969 | Farrar et al. | 53/386.1 |
| 3,490,195 | 1/1970 | Abramson | 53/572 X |
| 3,545,175 | 12/1970 | Lillund | 53/386.1 |
| 3,590,553 | 7/1971 | Formo | 53/572 X |
| 3,594,981 | 7/1971 | Pitts | 53/386.1 |
| 3,894,905 | 7/1975 | Ehlscheid . | |
| 4,015,515 | 4/1977 | Johnson | 53/386.1 |
| 4,064,674 | 12/1977 | Palmer . | |
| 4,149,356 | 4/1979 | Palmer . | |
| 4,300,331 | 11/1981 | Yoshiba . | |
| 4,365,458 | 12/1982 | Palmer et al. . | |
| 4,551,966 | 11/1985 | Aoyagi et al. . | |
| 4,567,715 | 2/1986 | Sawa et al. | 53/572 |
| 4,649,178 | 2/1987 | Garratt et al. . | |
| 4,685,277 | 8/1987 | Ilsemann . | |
| 4,693,659 | 9/1987 | Burke et al. . | |
| 4,733,856 | 3/1988 | Gunther, Jr. . | |
| 4,748,799 | 6/1988 | Truc et al. | 53/386.1 |
| 4,805,381 | 2/1989 | Hannon | 53/572 X |
| 4,910,675 | 3/1990 | Burns et al. | 364/478 |
| 5,046,305 | 9/1991 | Skubic et al. | 53/572 |

*Primary Examiner*—Horace M. Culver

*Attorney, Agent, or Firm*—Palmatier, Sjoquist & Helget

[57] ABSTRACT

An apparatus which receives computer diskettes, sleeves the diskettes, and further conveys the diskettes. The apparatus has a receiving port into which computer diskettes are conveyed. A pair of friction rollers convey the diskettes toward the open end of the topmost sleeve in the stack. The open end is held open by a hold-down flap depressing the flap on the lower layer of the sleeve, an insert finger inserted from above the sleeve, and a suction means to uplift the top layer of the sleeve. The diskette is conveyed until it is fully within the sleeve at which point the sleeved diskette engages the curved top edge of a singulate gate slidably attached to the frame. The engagement of the sleeved diskette with the curved top edge of the gate overcomes the upward bias of the gate to slide the gate downwardly to allow the sleeved diskette to pass over the gate and be further conveyed. An additional pair of friction drive rollers located above the exit gate further convey the sleeved diskette out of the sleeve apparatus. The curved edge portion of the slidable gate contains microgrooves which run transverse the direction of travel of the sleeved diskettes. The microgrooves are effective to inhibit empty sleeves from being conveyed over the exit gate along with the sleeved diskette.

16 Claims, 5 Drawing Sheets

SLEEVER APPARATUS WITH SINGULATE GATE

BACKGROUND OF THE INVENTION

The present invention relates to the processing of computer diskettes. More particularly, the invention relates to an apparatus for sleeving computer diskettes.

The invention is related to the device disclosed in U.S. Pat. No. 4,910,675, issued Mar. 20, 1990, which disclosed a processing and packaging system for prerecorded computer diskettes including a sleever mechanism. The present invention is suitable for use in such a system or similar systems or applications.

The invention is also related to U.S. Pat. No. 5,046,305 issued Sep. 10, 1991, which disclosed a similar sleever apparatus. Both U.S. Pat. Nos. 4,910,675 and 5,046,305 are owned by the assignee of the present invention.

The two types of diskettes most commonly available are the 3½ inch diameter disk which is enclosed in a rigid plastic shell and the 5¼ inch diameter disk which has a flexible cover and a radially-extending slot which exposes the floppy disk. Although the 3½ inch diameter diskettes typically are not sleeved in that they have the rigid plastic protective shell, the 5¼ diskettes require a protective sleeve before packaging. The sleeves typically utilized have three closed sides and an open end into which the diskette is inserted.

SUMMARY OF THE INVENTION

The present invention is an apparatus which receives computer diskettes, sleeves the diskettes, and further conveys the diskettes. The apparatus has a receiving port into which computer diskettes are conveyed. At the inlet port a pair of friction rollers further convey the diskettes toward the open end of the topmost sleeve in the stack. The open end is held open by a hold-down flap depressing the flap on the lower layer of the sleeve, an insert finger inserted from above the sleeve, and a suction means to uplift the top layer of the sleeve. The diskette is conveyed until it is fully within the sleeve at which point the sleeved diskette engages the curved top edge of a singulate gate slidably attached to the frame. The engagement of the sleeved diskette with the curved top edge of the gate overcomes the upward bias of the gate to slide the gate downwardly to allow the sleeved diskette to pass over the gate and be further conveyed. An additional pair of friction drive rollers located above the exit gate further conveys the sleeved diskette out of the sleeve apparatus. The curved edge portion of the slidable gate contains microgrooves which run transverse the direction of travel of the sleeved diskettes. The microgrooves are effective to inhibit empty sleeves from being conveyed over the exit gate along with the sleeved diskette.

An advantage of the invention is that the apparatus reliably sleeves diskettes with minimum jamming and minimum discharge of empty sleeves.

DETAILED DESCRIPTION OF THE PREFERRED EMBODIMENTS

Figure 1:
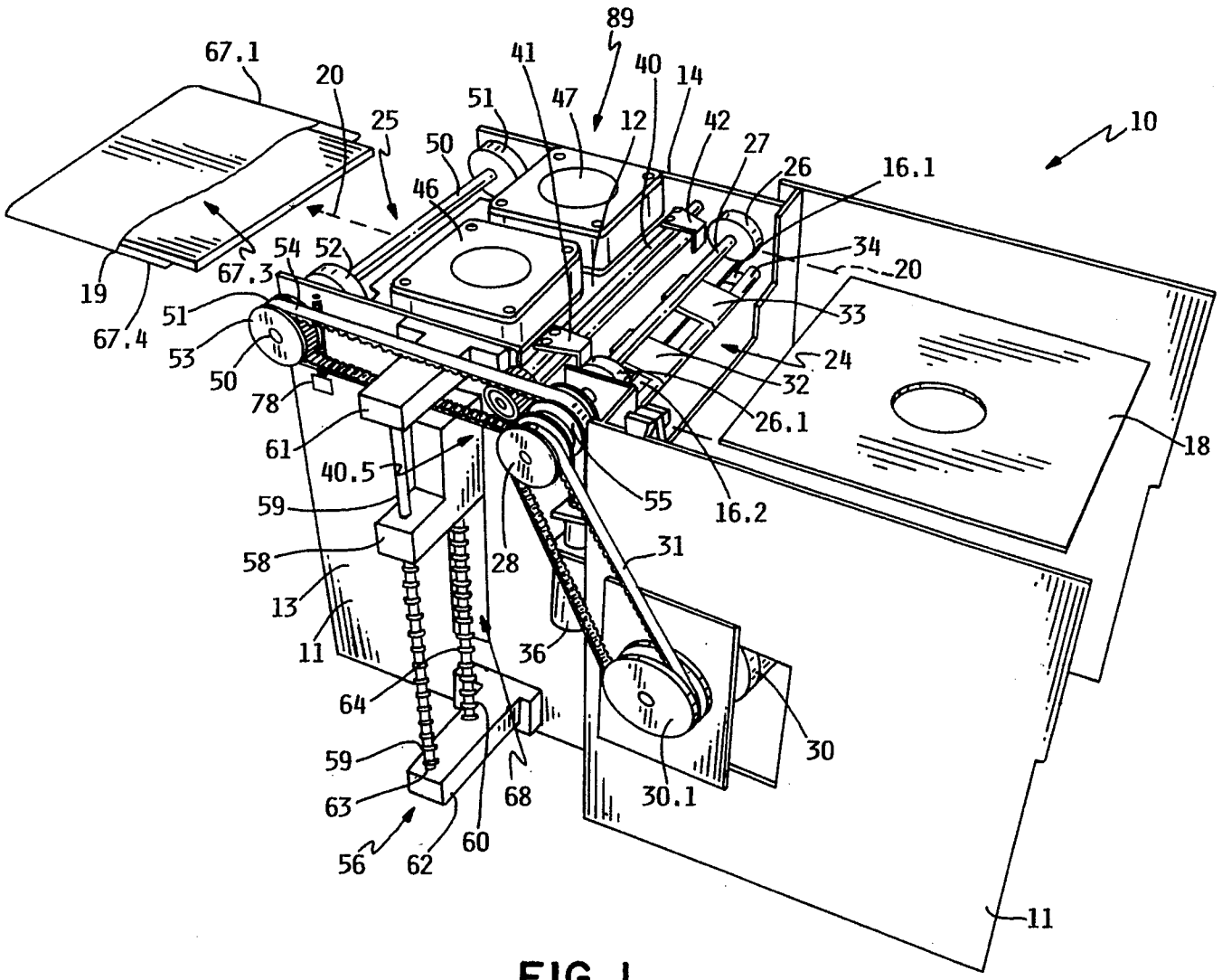
FIG. 1 shows a perspective of the invention.

A preferred embodiment of the diskette sleeving apparatus 10 is shown in various views in FIGS. 1–8. The apparatus 10 has a frame 11 comprised of a top panel 12, a right side panel 13, a left side panel 14, a front panel 15, and a rear panel 16. FIG. 1 shows a computer diskette 18 positioned to be conveyed into a receiving port 24 above the rear panel 16 and a sleeved diskette 19 is shown exiting the discharge port 25. The dashed line and arrows labeled with numeral 20 indicate the path of travel of the computer diskettes in the various figures.

Figure 2:
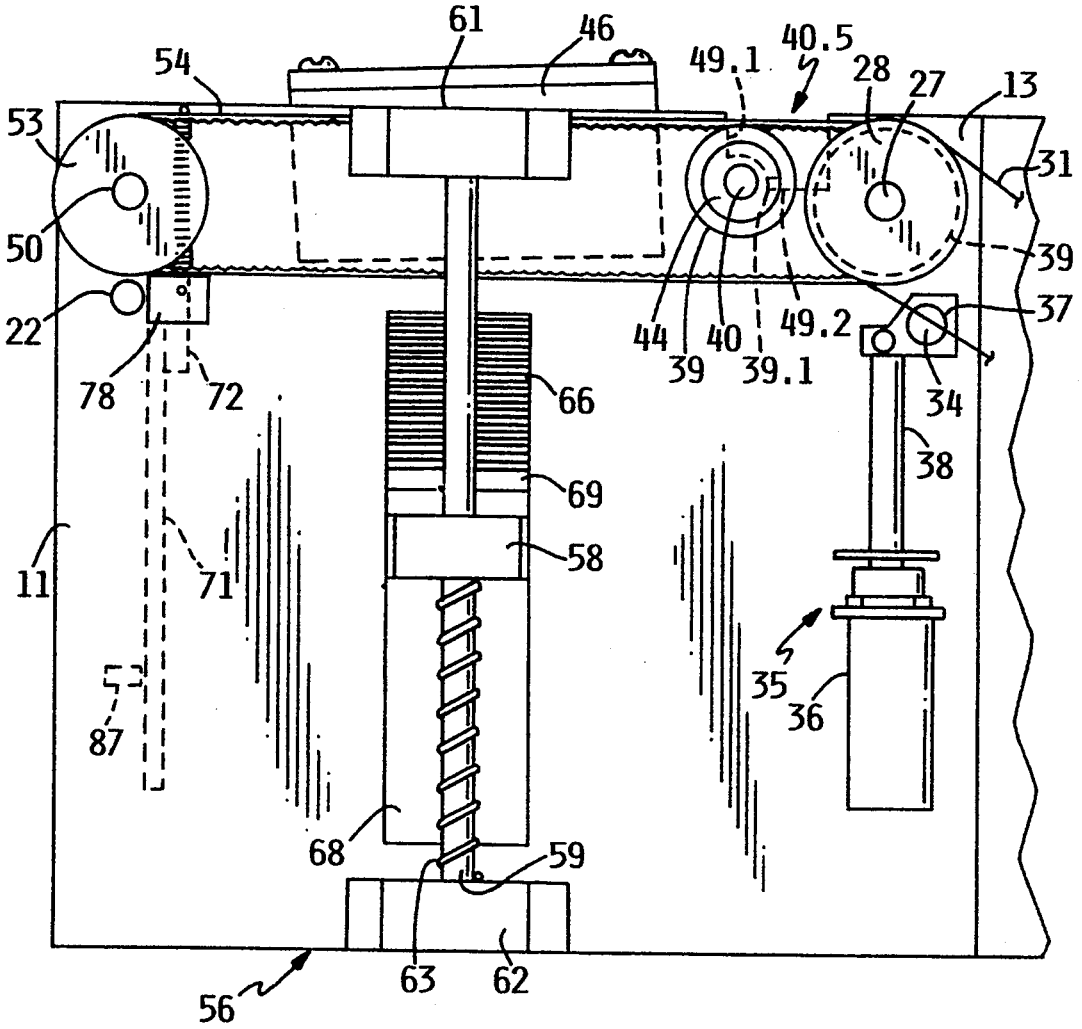
FIG. 2 is a side elevational view of a portion of the apparatus showing the right side panel.
Figure 4:
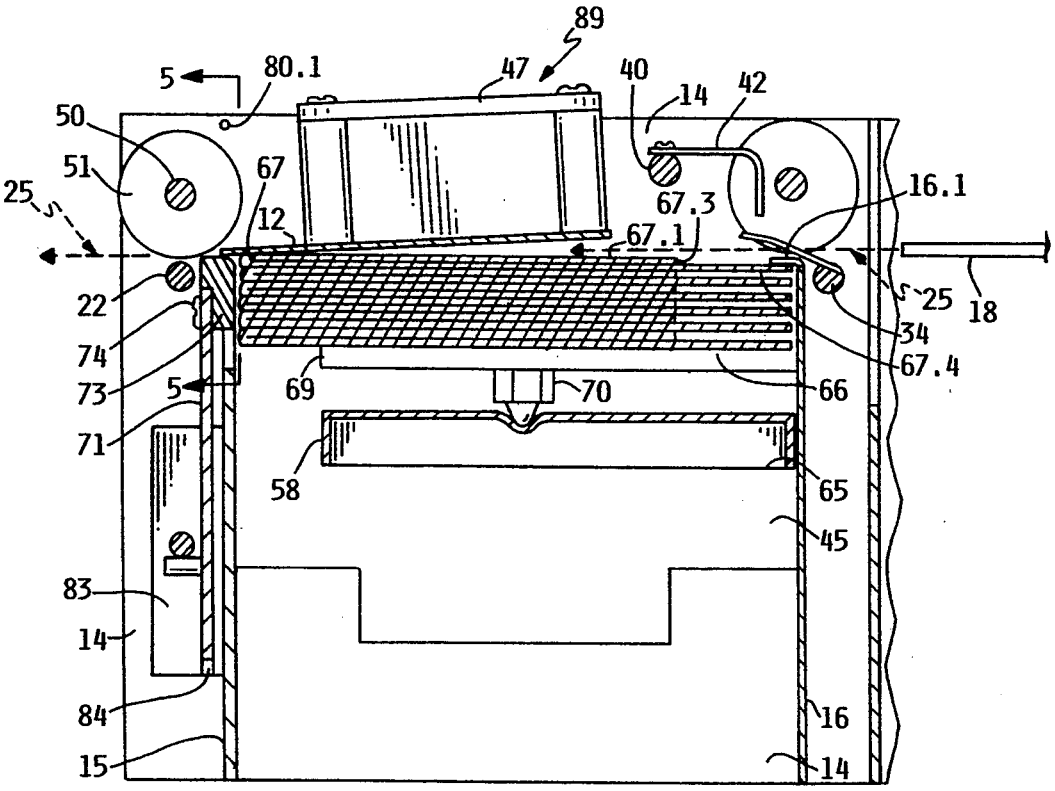
FIG. 4 is a partial sectional elevational view taken along lines 4—4 of FIG. 3 showing the top of the bin with the stacked sleeves and the singulate gate.

Referring to FIGS. 1 and 2, a conveyance means for conveying the diskettes along the path of travel 20 is comprised of a first shaft 27, a pair of friction rollers 26, 26.1, a pulley 28, a second shaft 50, another pair of friction rollers 51, 52, a pulley 53, a motor 30, a motor pulley 30.1, a belt 54, and another belt 31. The first shaft 27 is rotatably mounted to the frame 11 by suitable means. The pair of friction rollers 26, 26.1 and the pulley 28 are mounted on the first shaft 27. The pulley 28 is coupled to the motor 30 by way of the drive belt 31 and the motor pulley 30.1. The rear panel 16 is positioned directly below the first shaft 27 and the friction rollers 26, 26.1. Two projecting lips 16.1, 16.2 integral with the rear panel 16 are positioned directly below the friction rollers 26, 26.1 as best shown in FIG. 4. The projecting lips 16.1, 16.2 are appropriately spaced below the friction rollers 26, 26.1 to permit the engagement of the diskettes by the friction rollers 26, 26.1.

The second shaft 50 is rotatably mounted in the frame 11 with the friction rollers 51, 52 and the pulley 53 affixed to the shaft 50. The pulley 53 is driven by way of the belt 54 and the pulley 55 mounted on the first shaft 27. Directly below the second shaft 50 is a roller bar 22 rotatably mounted in the frame 11 and appropriately spaced below the second shaft 50 to permit engagement of the sleeved diskette 19 by the friction rollers 51, 52 as the sleeved diskette 19 moves out of the bin 65.

Referring to FIGS. 1, 2, and 4 the bin 65, which contains the stack of sleeves 66 including the topmost sleeve 67, is defined by the front panel 15, the rear panel 16, the right side panel 13, the left side panel 14, and the top panel 12. As shown in FIG. 4, the bin 65 is so oriented as to place the topmost sleeve 67 substantially into the path of travel 20 of the diskettes, defining a receiving position. Access to the bin 65 for adding sleeves is through the bin opening 45 located in the left side panel 14. Each sleeve has a top layer 67.1, a bottom layer 67.2, an open end 67.3, and a flap 67.4 extending from the bottom layer 67.2. Sleeves are stacked on the tray 69 with the top layer 67.1 of the sleeves 66 facing upwardly and the open end 67.3 toward the rear panel 16 and the receiving port 24. The thickness of the sleeves as depicted in FIGS. 4, 6, 7, and 8 is somewhat exaggerated in order to illustrate the operation of the apparatus 10.

A means 56 for upwardly biasing the stack of sleeves 66 is comprised principally of a tray 69 upon which the stack of sleeves 66 are stacked, a pivot 70, a tray support 58, a pair of guide shafts 59, 60, two brackets 61, 62 and two springs 63, 64. The brackets 61, 62 are secured to the right side panel 13 by suitable means. The springs 63, 64 encircling the guide shafts 59, 60 provide a gentle upward bias to the tray support 58 and tray 69 causing the top layer 67.1 of the topmost sleeve 67 to contact the top panel 12 and the projecting lips 16.1, 16.2 of the rear panel 16, as shown in FIG. 4. The tray 69 is pivotally placed on top of the tray support 58 by way of a pivot 70 which is secured to the tray 69 and which rides in the indentation 97 in the tray support 58. The right side panel 13 has an elongate vertical slot 68 through which the tray support 58 extends and moves vertically. The tray support 58 rides on the guide shafts 59, 60 which are supported by brackets 61, 62. The brackets 61, 62 are secured to the right side panel 13 by any suitable means.

Three means for opening the open end of the topmost sleeve 67 are shown in FIG. 1 and principally include the insert finger shaft 40 with a pair of insert fingers 41, 42 affixed to the insert finger shaft 40, a pair of fans 46, 47 mounted on the top panel 12, and a hold-down shaft 34 with hold-down flaps 32, 33. The insert fingers 41, 42 and the fans 46, 47 constitute uplift means to raise the top layer 67.1 of the topmost sleeve 67 whereas the hold-down flaps 32, 33 operate to hold down the bottom layer 67.2.

The insert finger shaft 40 is rotatably mounted in the frame 11 and has affixed to it a pair of insert fingers 41, 42. A means 40.5 for selectively rotating the insert finger shaft 40 less than 360° is shown in FIG. 2 and is comprised of a pulley 39 driven by belt 54 and mounted on a slip clutch 44, the slip clutch 44 is mounted on and engaged with the insert finger shaft 40, a tab 39.1 protruding from the pulley 39 and two edge stops 49.1, 49.2, shown in FIG. 2, which are formed as part of the right side panel 13. Clockwise rotation of the motor pulley 30.1 rotates the belt 31, the pulley 28, first rotatable shaft 27, the belt 54, pulley 39, and slip clutch 44. The insert finger shaft 40 and the insert fingers 41, 42 also rotate clockwise as shown in FIGS. 2, 4, 6 and 7 until the tab 39.1 contacts the edge stop 49.2 at which point the insert fingers 41, 42 are in the second position shown in FIGS. 6 and 7 and rotation of the insert finger shaft 40 ceases due to slippage in the slip clutch 44. Reversal of the motor 30 causes counterclockwise rotation of the pulley 39, the slip clutch 44, the insert finger shaft 40 and insert fingers 41, 42 until the tab 39.1 contacts the stop 49.1, best shown in FIG. 2, at which point the rotation insert finger shaft 40 stops and the insert fingers 41, 42 are in the first position shown in FIGS. 1 and 4.

Figure 6:
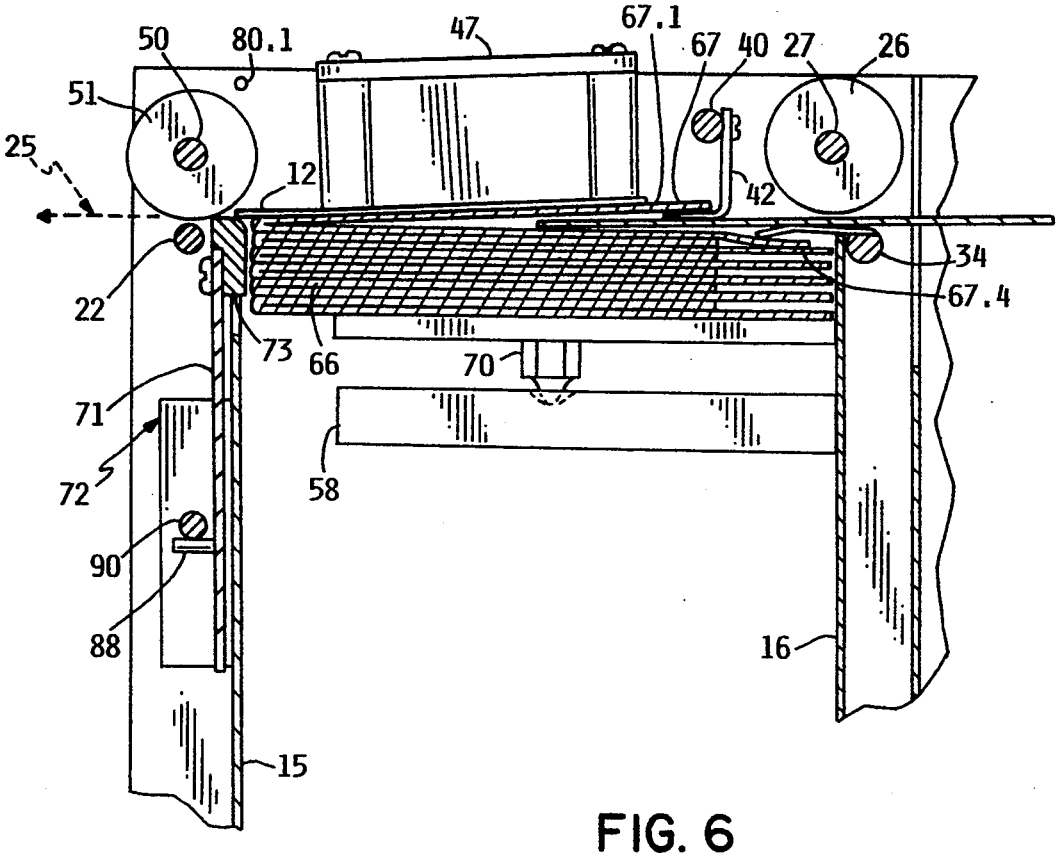
FIG. 6 shows the same view as FIG. 4 showing a computer diskette partially inserted into the topmost sleeve.

The pair of fans 46, 47 mounted to the top panel 12 provide a suction means by creating a negative pressure immediately below the top panel 12. The top panel 12 is slotted or perforated (not shown) directly below the fans 85, 86. An appropriate fan is Model No. FL12A306 manufactured by EG & G Rotron and disclosed in U.S. Pat. No. 4,494,028. Note that the top panel 12 is inclined as shown in FIG. 4. The top layer 67.1 of the topmost sleeve 67 is pulled upwardly by the negative pressure under the top panel 12, the inclination of the top panel 12 allows the top layer 67.1 at the open end 67.3 to be pulled away from the bottom layer 67.2 effecting opening of the open end 67.3 as shown in FIG. 6.

The hold-down shaft 34 is adjacent to the receiving port 24, is rotatably mounted to the frame 11 by suitable means, and extends through the right side panel 13. The pair of hold-down flaps 32, 33 are affixed to the hold-down shaft 34. A means 35 for selectively rotating the hold-down shaft 34 less than 360° is comprised of a solenoid 36 mounted to the right panel, the solenoid 36 having a solenoid plunger 38 and solenoid linkage 37. The solenoid 36 is attached to the frame 11 and the solenoid linkage 37 is attached to hold-down shaft 34 as best shown in FIG. 2. Activation of the solenoid 36 rotates the hold-down flaps 32, 33 from the position shown in FIG. 4 counterclockwise to depress the flap 67.4 of the topmost sleeve 67 as shown in FIG. 6.

Figure 3:
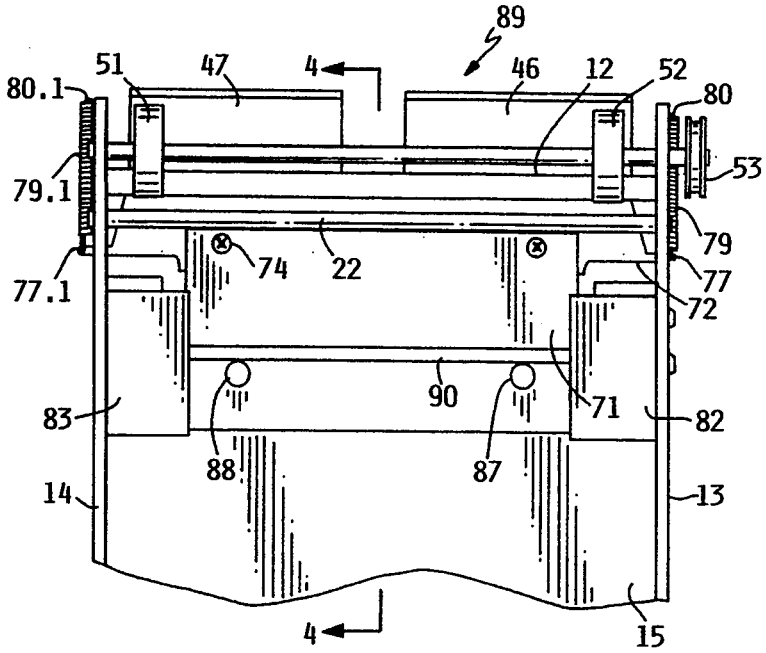
FIG. 3 shows a partial elevational view of the apparatus showing the front panel, the singulate gate, and the exit port.
Figure 5:
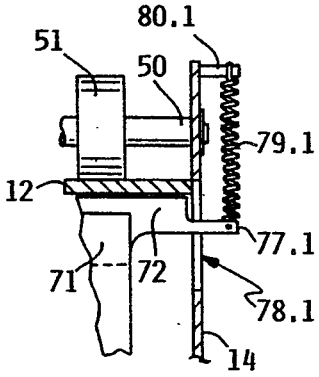
FIG. 5 is a partial cross-sectional view taken along lines 5—5 of FIG. 4.
Figure 7:
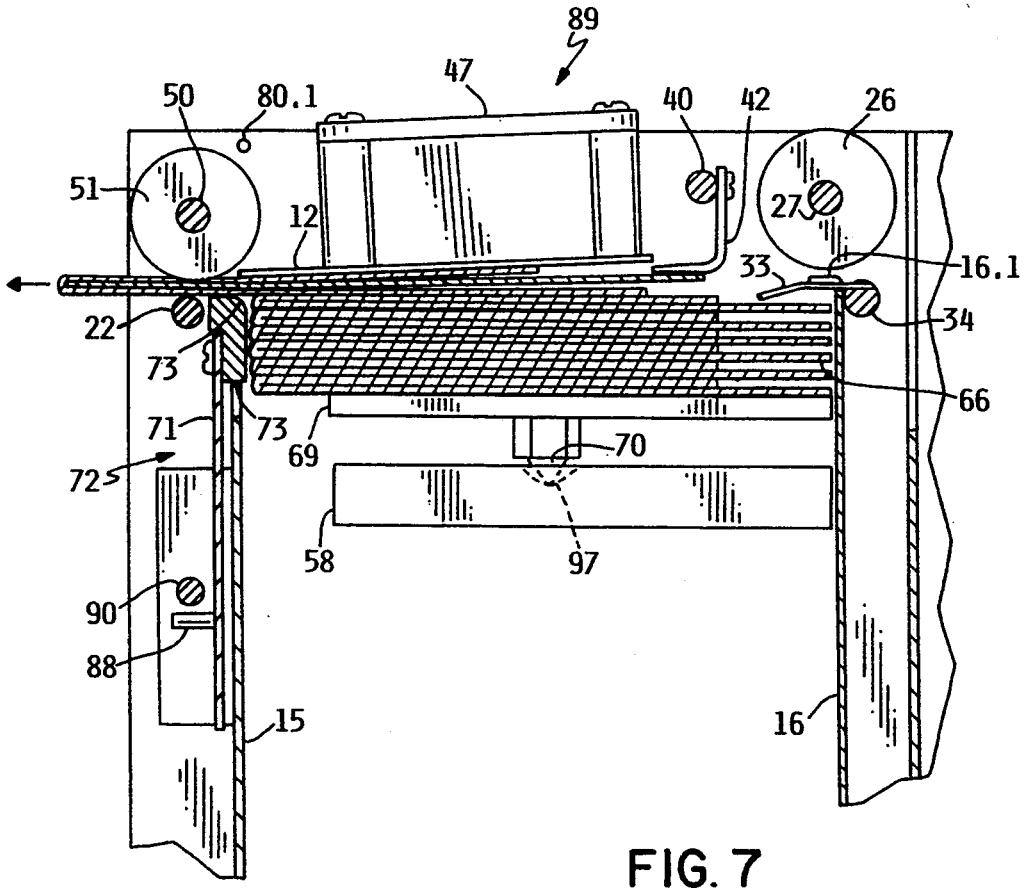
FIG. 7 is the same view as FIGS. 4 and 6 with the computer diskette fully inserted into a sleeve and partially conveyed out of the exit port.

The singulate gate 72 is shown in FIGS. 2–8. Referring to FIGS. 3 and 4, the singulate gate 72 is comprised of a rectangular mounting plate 71 onto which is mounted a lip member 75 by way of screws 74. The lip portion has a curved top edge 99 adjacent to the topmost sleeve 67. The singulate gate 72 is slidably mounted to the frame 11 by way of gate guides 82, 83 and has a blocking position as shown in FIG. 4 and an unblocking position as shown in FIG. 7. The gate guides 82, 83 each have a groove 84 into which the mounting plate 71 is slidably engaged. The upward limit of the vertical movement of the singulate gate 72 is limited by the contact of the stops 87, 88 which extend from the mounting plate 71, and the bar 90 extending between the gate guides 82, 83. The bar 90 may be vertically adjustable by any suitable means to control the closure between the top panel 12 and the lip member 75 of the singulate gate 72. A bias means to urge the singulate gate 72 upwardly is shown in FIGS. 2, 3, and 5 and is comprised of a pair of tabs 77, 77.1 extending from both sides of the lip member 75 through two frame openings 78, 78.1 to connect with two springs 79, 79.1 which are anchored to the frame 11 at two pins 80, 80.1.

Figure 8:
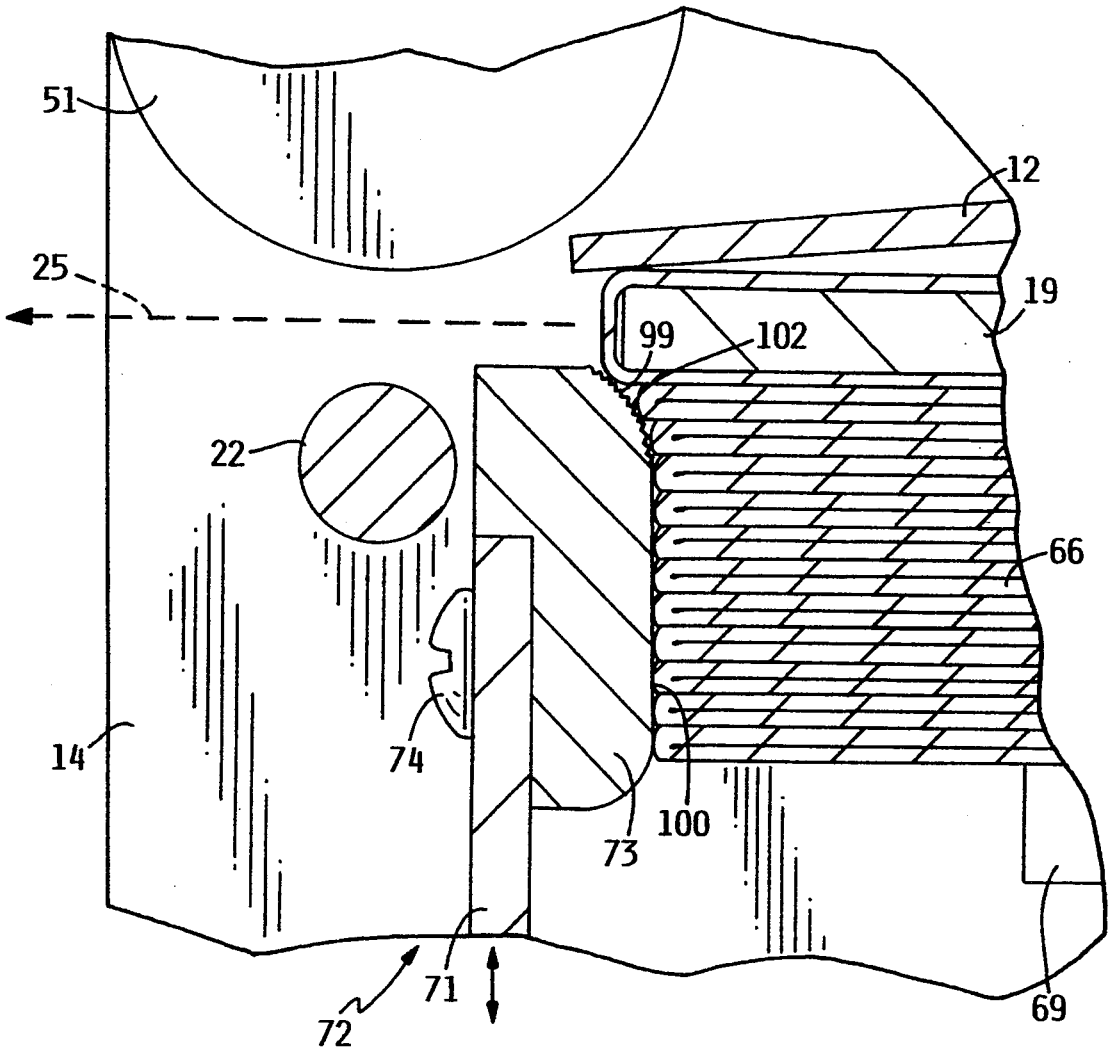
FIG. 8 is a detail cross sectional of portions of the singulate gate.

FIG. 8 shows a detail cross sectional of the lip member 75 of the singulate gate 72. The curved top edge 99 has microgrooves 102 extending transversely to the path of travel 20 and parallel with the stack of sleeves 66. In the preferred embodiment the lip member 75 is fabricated out of hard anodized aluminum with a teflon impregnation of at least 0.002 inches. A straight line 250 microfinish forms appropriate microgrooves in the curved top edge 99. An appropriate radius for the curved top edge 99 is 0.13 inches.

The device operates as follows: With a stack of sleeves 66, including a topmost sleeve 67, loaded in the bin 65 in the receiving position as shown in FIG. 4, the fans 46, 47 are activated. The negative pressure created under the top panel 12 by the fans 46, 47 causes the top layer 93 of the topmost sleeve 67 to be drawn into contact with the top panel 12, while the projecting lips 16.1, 16.2 retain the flap 67.4 and the bottom layer 67.2 below the path of travel 20. Rotation of the electric motor 30 in a clockwise manner drives the belt 31 to rotate the pulley 28, the shaft 27, and the friction rollers 26, 26.1. Belt 54 drives pulley 39 with slip clutch 44 which drives insert finger shaft 40 and insert fingers 41, 42 to effect insertion of the insert fingers 41, 42 into the open end 67.3 of the topmost sleeve 67. The insert finger shaft 40 only rotates to the position as shown in FIG. 6 due to the tab 39.1 engaging the stop 49.2. The solenoid 36 is then activated which pulls the solenoid plunger 38 downwardly and rotates the solenoid linkage 37 counterclockwise which partially rotates shaft 34. This partially rotates the hold-down flaps 32, 33 from the position shown in FIG. 4 to the position of FIG. 6. The hold-down flaps 32, 33 depress the flap 100 extending from the lower layer 101 of the topmost sleeve 67. Activation of the solenoid 36 is sequenced to occur after the insert fingers 41, 42 have been inserted into the open end of the sleeve. This may be accomplished by optical sensors, not shown, which are positioned to sense a diskette being conveyed to the receiving port 24 and appropriately activate the solenoid 36. The diskette 18 is conveyed to the sleeving apparatus 10 by external means to be received at the receiving port 24 intermediate the projecting lips 16.1, 16.2 and the friction rollers 26, 26.1. The diskette 18 is engaged by the friction rollers 26, 26.1 which further convey the diskette along the path of travel 20 into the topmost sleeve 67 as shown in FIG. 6.

The depression of the flap 67.4 by the hold-down flaps 32, 33 and the adhesion of the top layer 67.1 of the sleeve by the suction from the fans 46, 47 and the microgrooves 102 in the curved top edge 99 effectively provides resistance to prevent the topmost sleeve 67 from moving along the path of travel 20 prior to the complete insertion of the diskette 18 into the sleeve 67.

When the friction rollers 26, 26.1 have conveyed the diskette 18 to the point where it is fully inserted into the topmost sleeve 67 the sleeved diskette 19 confronts the singulate gate 72. As best shown in FIG. 8, the sleeved diskette 19 engages the curved top edge 99 of the lip member 75 which urges the sleeved diskette 19 upwardly to the top panel 12 and out the discharge port 25 minimizing jamming. Additionally, engagement of the curved top edge 90 by the conveyed sleeved diskette 19 effects a downward force on the singulate gate 72 overcoming the upward bias of springs 79, 79.1 to move the singulate gate 72 from the blocking position to the unblocking position. This allows the sleeved diskette 19 to pass over the singulate gate 72 out of the receiving position and to be further conveyed into engagement with the friction rollers 51, 52 and roller bar 22 and to be discharged from the discharge port 25.

Prior to receiving the next diskette, the motor 30 is reversed and the solenoid 36 is released. This rotates the insert fingers 41, 42 back to the first position and rotates the hold-down flaps 32, 34 back to the first position which allows the next sleeve in the stack of sleeves 66 to move into position for opening and receiving the next diskette.

The microgrooves 102 in the curved top edge 99 of the lip member 75 are too small to inhibit the passage of the sleeved diskette 19 but effectively engage the stacked sleeves 66 below the sleeved diskette 19 providing enough resistance to prevent any of the stacked sleeves 66 moving with the sleeved diskette 19 over the singulate gate 72.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A diskette sleeving apparatus for receiving conveyed computer diskettes, sleeving the diskettes, and further conveying the sleeved diskettes, the sleeves comprising a top layer, a bottom layer and having an open end, the bottom layer having a flap extending beyond the open end, the apparatus comprising:

a) conveyance means for conveying the diskettes along a path of travel;

b) a bin for holding a stack of sleeves, the bin having a means of biasing the stack of sleeves, the stack having a topmost sleeve, the bin so oriented as to place the topmost sleeve in a receiving position substantially into the path of travel, the sleeves stacked with the top layer facing upwardly and the open end directed into the path of travel;

c) means for opening the open end of the topmost sleeve for insertion of a conveyed diskette; and d) a singulate gate transversing the path of travel, adjacent to the topmost sleeve opposite the open end and the singulate gate having a blocking position and having an unblocking position, bias means for urging the singulate gate into the blocking position, the singulate gate having a curved top edge adjacent the topmost sleeve, the curved top edge having a series of microgrooves transverse to the path of travel; whereby as the conveyed diskette with the topmost sleeve is conveyed out of the receiving position engages the curved top edge of the singulate gate, moving the singulate gate from the blocking position to the unblocking position, allowing the conveyed diskette with the topmost sleeve to be further conveyed, and whereby the microgrooves inhibit conveyance of any other sleeves.

2. The apparatus of claim 1, wherein the means for opening the topmost sleeve comprises a partially rotatable hold-down shaft and a hold-down flap affixed to the hold-down shaft, the shaft positioned below the path of travel adjacent to the open end of the topmost sleeve in the bin, a means for selectively rotating the shaft less than 360° between a first position and a second position, the hold-down flap so configured that in the first position the hold-down flap is positioned above the topmost sleeve and in the second position, the hold-down flap depresses the flap of the bottom layer of the topmost sleeve.

3. The apparatus of claim 2, wherein the means for opening the topmost sleeve comprises a rotatable insert finger shaft, an insert finger affixed to the shaft, the shaft positioned above the open end of the topmost sleeve in the bin, means for selectively rotating the shaft less than 360° between a first position and a second position, the insert finger so configured that the insert finger is withdrawn from the open end of the topmost sleeve at the first position and is inserted into the open end when said shaft is at the second position.

4. The apparatus of claim 2, wherein the means for opening the topmost sleeve further comprises a suction means for urging the top layer of the topmost sleeve upwardly, the suction means positioned above the bin.

5. The apparatus of claim 4, wherein the suction means comprises a fan secured above the top layer of the topmost sleeve in the bin.

6. The apparatus of claim 5, wherein the means for conveying the diskettes along the path of travel comprises a first shaft, a friction-drive roller affixed to the shaft, and a drive means for rotating the friction drive roller, the friction drive roller positioned adjacent to the open end of the topmost sleeve along the path of travel for receiving the conveyed diskettes and further conveying the diskettes along the path of travel.

7. The apparatus of claim 6, wherein the means for conveying the diskettes further comprises a second friction roller position along the path of travel at the singulate gate for further conveying the sleeved diskettes.

8. The apparatus of claim 6, wherein the singulate gate is slidably attached to the bin.

9. The apparatus of claim 7, wherein the curved top edge is composed of hard anodized aluminum with a teflon impregnation.

10. The apparatus of claim 1, wherein the means of biasing the stack of sleeves comprises a tray support, a tray pivotally mounted on the tray support, a guide bar, the tray support riding vertically on the guide bar.

11. A diskette sleeving apparatus for receiving conveyed computer diskettes, sleeving the diskettes, and further conveying the sleeved diskettes, the sleeves comprising a top layer, a bottom layer and having an open end, the bottom layer having a flap extending beyond the open end, the apparatus comprising:

a) a rigid frame comprising a top panel;

b) a motor;

c) a first shaft rotatably mounted to the frame, and coupled to the motor, a friction drive roller mounted on the shaft, the first shaft and friction roller so positioned as to receive the conveyed diskettes and to further convey the diskette along a path of travel;

d) a bin contained within the frame for holding a stack of sleeves, the stack of sleeves having a topmost sleeve, an upwardly biased tray to hold the stack of sleeves, the bin positioned under the top panel and so oriented as to place the topmost sleeve substantially into the path of travel of the conveyed diskettes;

e) a singulate gate slidably mounted to the frame confronting the top panel, the singulate gate having a blocking position and an unblocking position and biased toward the blocking position, the singulate gate having a curved top edge, the singulate gate oriented so that the curved top edge transverses the path of travel in the blocking position;

f) a hold-down shaft rotatably mounted to the frame below the path of travel, a hold-down flap affixed to the hold-down shaft, a solenoid attached to the frame and linked to the hold-down shaft whereby activation of the solenoid rotates the hold-down shaft from a first position to a second position, the hold-down shaft and hold-down flap so configured that the hold-down flap in the second position depresses the flap of the bottom layer of the topmost sleeve and in the first position the hold-down flap is substantially raised above the flap of the topmost sleeve;

g) a second shaft rotatably mounted to the frame and coupled to the motor, a friction roller affixed to the shaft, the shaft positioned along the path of travel beyond the singulate gate; and h) means for uplifting the top layer of the topmost sleeve whereby the diskette conveyed along the path of travel is inserted into the topmost sleeve and further conveyed to engage the curved top edge of the singulate gate to move the singulate gate to the unblocking position and to further convey the diskette with the sleeve to the second shaft and friction roller.

12. The apparatus of claim 11, wherein the curved top edge of the singulate gate has a series of microgrooves transverse to the path of travel.

13. The apparatus of claim 12, wherein the curved top edge of the singulate gate is composed of teflon impregnated hard anodized aluminum.

14. The apparatus of claim 13, wherein the curved portion of the singulate gate has a radius of between 0.06 inches and 0.26 inches.

15. The apparatus of claim 12, wherein the means for uplifting the top layer of the topmost sleeve comprises a rotatable insert finger shaft, an insert finger affixed to the shaft, the shaft positioned above the open end of the topmost sleeve in the bin, a means for selectively rotating the shaft less than 360° between a first position and a second position, the insert finger so configured that the insert finger is withdrawn from the open end of the topmost sleeve at the first position and is inserted into the open end when said shaft is at the second position.

16. The apparatus of claim 12, wherein the means for opening the topmost sleeve further comprises a suction means for urging the top layer of the topmost sleeve upwardly, the suction means positioned above the bin.

* * * * *